US006316060B1

(12) United States Patent
Elvidge et al.

(10) Patent No.: US 6,316,060 B1
(45) Date of Patent: Nov. 13, 2001

(54) METERING COATINGS

(75) Inventors: David Richard Elvidge; Malcolm Kenneth Smith, both of North Vancouver (CA)

(73) Assignee: Pacifica Papers Inc., Vancouver (CA)

( * ) Notice: Subject to any disclaimer, the term of this patent is extended or adjusted under 35 U.S.C. 154(b) by 701 days.

(21) Appl. No.: 08/700,020

(22) Filed: Aug. 20, 1996

(51) Int. Cl.[7] ..... B05D 3/00

(52) U.S. Cl. ..... 427/565; 427/428; 427/600; 427/601

(58) Field of Search ..... 427/565, 600, 427/601, 428

(56) References Cited

U.S. PATENT DOCUMENTS 4,088,074 * 5/1978 Dahlgren et al. ..... 101/350

FOREIGN PATENT DOCUMENTS 2031705 12/1990 (CA) .
2040845 10/1991 (CA) .
2078320 2/1993 (CA) .
2078735 3/1993 (CA) .
2082121 5/1993 (CA) .

* cited by examiner

*Primary Examiner*—Bernard Pianalto
(74) *Attorney, Agent, or Firm*—C. A. Rowley

(57) ABSTRACT

The amount of coating dispensed by a metering rod type applicator such as used on size press coater for applying coating onto the size press rolls can be reduced by vibrating the metering rod. Such vibration of the metering rod has been found to reduce the thickness of the film passing through the metering nip of the coating applicator for a given metering nip rod pressure.

5 Claims, 1 Drawing Sheet

METERING COATINGS

FIELD OF INVENTION

The present invention relates to metering rod type coaters and in particular, to a coater having improved control of the coat weight of the coating formulation being applied.

BACKGROUND OF THE INVENTION

The use of metering rod type applicators for applying coating to a surface such as the surface of a roll of a size press coater for application to a web passing through the nip of the size press coater are well known and have been in commercial use for some time. Examples of such equipment are shown in Canadian published patent applications 2,078,320 published Feb. 17, 1993 to Rantanen, 2,078,735 published Mar. 20, 1993 to Beisswanger, 2,082,121 published May 7, 1993 to Rantanen et al. or 2,040,845 published Oct. 20, 1991 to Rantanen.

In these devices, generally, the pressure applied in the nip formed between the metering rod and the backing surface (generally the surface of an application roll) is used to meter the amount of coating that passes through the nip and is available for application to the web in the size press coater. Generally, the amount of coating passing through the nip is also significantly affected by the diameter of the metering rod and hardness of the backing surface. The rheology of the coating also influences the passage of the coating through the nip. Generally, as the solids content of the coating increases, the film thickness on the supporting surface leading to the size press application nip must be reduced to apply the same coating solids to the web.

When operating at the pressure limit for the nip, the coat weight passing through the nip and available for application to the web may be too large and must be accommodated for by reducing coating solids, however, this affects the application and take up of the coating by the web as well as the quality of the coated sheet.

Redesign of the equipment to permit increase in the pressure applicable in the metering nip formed by the rod and the backing surface may further extend the range of control of coat weight. However, this, in many cases, is simply not practical.

It has been found, at least for some coating formulations, increasing nip pressure above a threshold in a given nip configuration does not significantly influences the amount of coating passing through the nip.

BRIEF DESCRIPTION OF THE PRESENT INVENTION

It is an object of the present invention to improve the metering ability of a metering rod type applicator to control the amount of coating metered onto the transfer surface.

Broadly, the present invention relates to a metering rod coating applicator and method for applying a coating to a transfer surface comprising a coating head, passage means for delivering coating from said coating head toward said surface, a metering rod, means for pressing said metering rod toward said surface to form a metering nip between said rod and said surface to meter the amount of coating passing through said nip, means to vibrate said rod, said means to vibrate said metering rod to reduce the amount of coating passing through said nip at a given pressure applied in said nip.

Preferably, said surface is a peripheral surface of a transfer roll of a size press coater.

Preferably, said means to vibrate applies vibrating forces substantially axially of said rod.

Preferably, said means to vibrate said rod by applying vibrations having a frequency in the range of 10 to 1000 Hz, more preferably 20 to 200 Hz and an amplitude in the range of 1 to 10 mils RMS, preferably 2 to 5 mils RMS to said rod.

Preferably, said amplitude will be in the range of 2.8 to 28 mils peak to peak.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
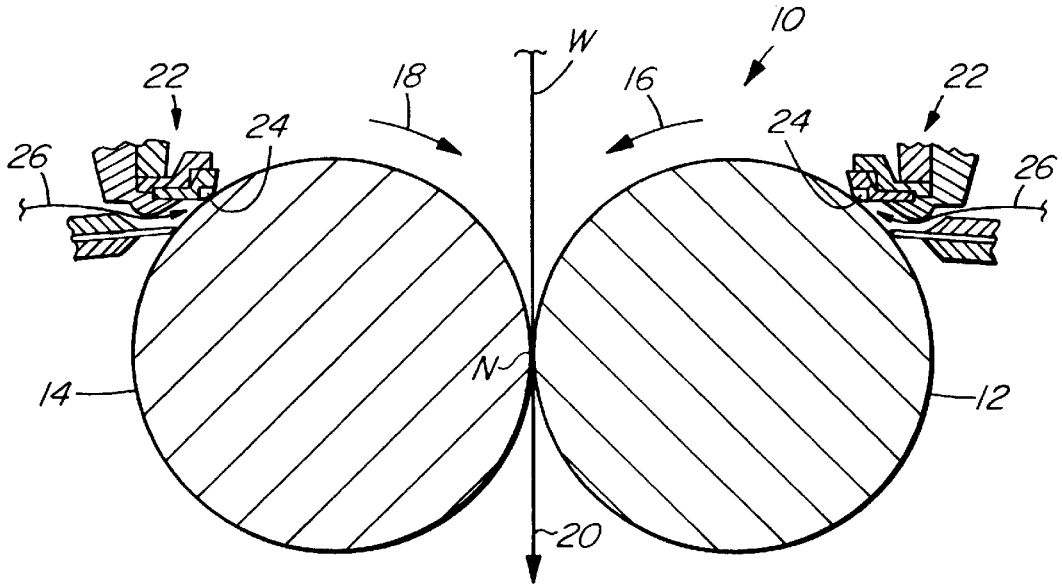
FIG. 1 is a cross-section schematically illustrating the typical size press coater using metering rod type coating heads.

As shown in FIG. 1, a typical size press coater 10 is formed by a pair of sized press rolls 12 and 14 which formed a nip N therebetween and through which a paper web or the like W to be coated passes. The rolls 12 and 14 are rotated as indicated by the arrows 16 and 18 in the direction of movement of the web W through the nip N as indicated by arrow 20.

In the illustrated arrangement, a pair of coating heads 22 apply coating to the rolls 12 and 14 respectively. Each of these coating heads 22 are of the type known in the art as rod type applicators in that the rod such as the rod 24 forms a nip 28 with the surface of its respective roll 12 or 14. Coating to be applied is delivered to the head 22 and nip 28 as indicated by the arrow 26. The nip 28 meters the amount of coating applied by the coating heads 22 onto their respective transfer rolls 12 and 14.

Figure 2:
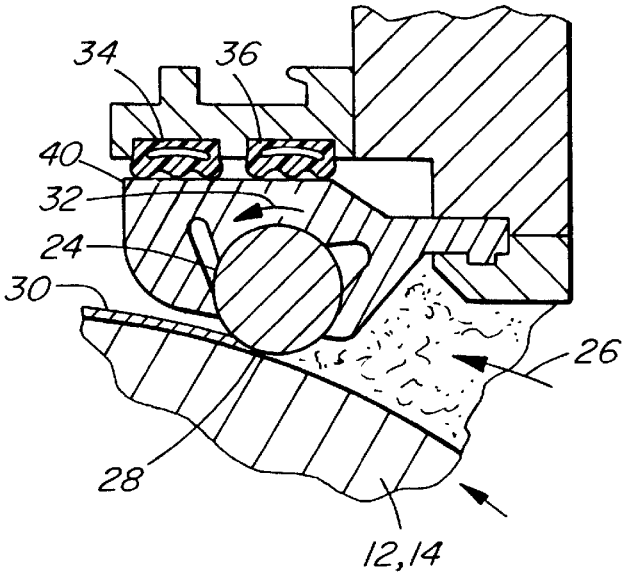
FIG. 2 is an enlarged view showing pressure application to a metering rod forming a typical metering nip.

As more clearly illustrated in FIG. 2, the roll 24 forms nip 28 with its respective rolls 12 or 14 to meter the coating or flow of coating 26 applied to the surface of the roll 12 or 14 to form the film 30 on the surface of the roll 12 or 14 in position for application to the web W in the nip N. Generally, the rod 24 is rotated by a suitable drive means as schematically indicated by the arrow 32. The nip pressure in the nip 28 between the rod 24 and roll 12 or 14 is determined by pneumatic inflatable tubes or the like, a pair of which have been illustrated at 34 and 36 in FIG. 2. The air pressure within these tubes expand the tubes 34 and 36 and presses the roll 24 towards the roll 12 or 14. The pressure within the nip 28 is adjusted by adjusting the pneumatic pressure in the bellows 34 and 36.

In the preferred embodiment of the present invention, the rod 24 is vibrated as indicated by the double headed arrow 38 by the application of vibrations substantially axially of the rod 24 (in a practical test of the present invention, these vibrations were applied by a pneumatic vibrator applied against the end cap of the rod 24 as will be discussed in the Examples hereinbelow).

Figure 3:
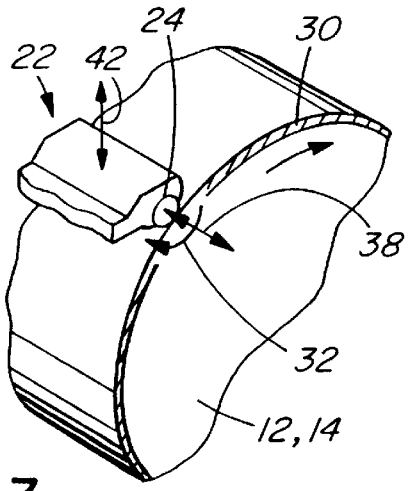
FIG. 3 schematically illustrates the application of vibrations to the metering rod in accordance with the present invention.

It is also possible to vibrate the mounting housing 40 for the rod 24 to provide a substantially radial vibration as indicated schematically by the double headed arrow 42 (see FIG. 3) or a combination of such vibration may be used (i.e. both axial and radial). However, it is preferred to use the axial vibration as illustrated by the double headed arrow 38.

Generally, with metering rod type coaters, the solid contents of the coating ranges between 30 and 70%, more preferably, 54 and 60%, and has a low shear viscosity in the range of 200 to 3,000 cps, preferably 500 to 1200 cps and a high shear viscosity of between 20 and 120 cps, preferably between 30 and 55 cps.

Generally, in most metering rod applications, the diameter of the metering rod is between 10 and 50 cm and it is rotated generally opposite to the direction of movement of the surface of the roll 12 or 14 through the nip 28. The rod 24 is generally-rotated at an rpm in the range of about 2to 200 rpm, preferably 30 to 70 rpm.

The pressure will normally be applied to the nip 28 by applying between 5 and 50 psi, pneumatic pressure to the tubes or bellows 34 and 36 and more preferably by applying between about 20 and 35 psi. Obviously, other means may be substituted for the pneumatic pressure application. The actual nip pressure will also depend on the rod diameter and surface hardness which is selected by selecting the hardness of a sleeves formed on the roll 12 and 14 and against which the rod 24 presses.

These conditions are generally used to apply a wet film weight, i.e. a film 30 having a weight in the range of 5 to 50 gm/$^2$, preferably between about 10 and 35 gm/m$^2$ of which generally about 50 to 90% is taken up on the web W.

Based on limited experimentation, it is believed that for effective operation of the present invention, the frequency of vibration is not critical but should preferably be in the range of about 10 to 1000 Hz, more preferably 20 to 200 Hz and have an amplitude in the range of about 1 to 10 mils RMS, preferably, 2 to 5 mils RMS. Generally, this amplitude range when specified as peak to peak, will be about 2.8 to 28 mils, preferably 5.6 to 14 mils peak to peak.

EXAMPLE 1

A typical coating color made down at 58% solids content had low shear viscosity (Brookfield 100 rpm) 824 cps and high shear viscosity (Haake) 42 cps. The solids at the start of the coating run was 56.9% and at the end 56.2%. The coating was applied at about 10 gm$^2$ and at a web speed of 1050 m/min to the wire side only of a 43 g/m$^2$ base paper by means of a Valmet pilot Sym-Sizerm™ with the 35 mm diameter metering rod rotating at 50 rpm under a pressure of 20 psi in the loading tube. A sample of the coating film 30 applied to the applicator or transfer roll 12 (14) was scraped from the roll and from the weight of coating collected the wet film weight was calculated to be 31.7 g/m$^2$.

A pneumatic vibrator was then applied to a metal cap on the tending end of the rotating metering rod 24 to apply axial vibration to the metering rod. The vibration applied had a frequency about 100 Hz and an amplitude about 3 mils RMS. With the vibration applied to the metering rod a sample of the coating film 30 was scraped and from its weight (the wet film weight) was calculated as 24.2 g/m$^2$.

A 24% reduction in the metered film weight was thus achieved as a result of application of the vibration to the metering rod.

EXAMPLE 2

Another batch made down of the same coating formulation described in Example 1, at the start of the coating run, had a solids content of the color 56.5% and at the end, a solids content of 55.5%. At the start of the coating run, the low shear viscosity (Brookfield 100 rpm) of the coating was 616 cps and the high shear viscosity (Haake) 36 cps. The coating was applied at about 10 g/m$^2$ and 875 m/min web speed to the wire wide only of a 43 g/m$^2$ base paper web by means of a Valmet pilot Sym-Sizer with 35 mm diameter metering rod rotating at 65 rpm. As in Example 1, for some of the tests, a pneumatic vibrator was clamped against a metal end cap on the tending end of the metering rod. With the vibrator turned off, the pressure in the rod loading tube was changed to three settings as set out in Table I below and a sample of coating film was scraped from the applicator roll giving the wet film weights in the table below. The vibrator was then turned on and the three scraping tests were then repeated at the same three rod loading pressures. The vibrator in each test operated at a frequency of 90 Hz and amplitude of 3 mils RMS or 8.5 mils peak to peak.

The vibration applied to the metering rod in this Example caused as much as 14% decrease in wet coating film weight. The effect of the vibration was greatest at the highest loading tube pressure and was reduced at lower tube pressures.

TABLE I

| Test No. | Vibrator | Loading Tube Pressure (psi) | Wet Film Weight (g/m$^2$) |
|---|---|---|---|
| 1 | off | 15 | 22.7 |
| 2 | off | 25 | 21.9 |
| 3 | off | 35 | 20.8 |
| 4 | on | 35 | 17.9 |
| 5 | on | 25 | 20.9 |
| 6 | on | 15 | 22.2 |

It is apparent that application of vibrations to the metering rod in substantially all tested circumstances (metering nip pressures) is effective to reduce the wet film weight applied to the surface of the rolls 12 or 14. However, at the higher metering nip pressures, the application of vibrations to the metering rod were most effective.

This mode of operation permits the use of higher solids content coating formulations which require a lower film weight for a given coating application to the web and in many existing rod type coaters is the only way known to Applicant of permitting the use of high solids coating formulations at low coating application rates.

Having described the invention, modifications will be evident to those skilled in the art without departing from the scope of the invention as defined in the appended claims.

We claim:

1. Method of applying a coating to a surface comprising delivering said coating to a coating chamber opening toward said surface, moving said surface relative to said chamber, metering in a metering nip formed between said surface and a metering means the amount of said coating carried from said chamber with said surface as said surface moves from said chamber, continually vibrating said metering means in said nip to reduce the amount of coating passing said metering means with said surface as said surface leaves said chamber.

2. A method as defined in claim 1 wherein said continually vibrating applies vibrations having a frequency in the range of 10 to 1000 Hz at an amplitude in the range of 1 to 10 mils RMS to said metering means at said nip.

3. A method as defined in claim 2 wherein said frequency is in the range of 20 to 200 Hz and said amplitude is in the range of 2 to 5 mils RMS.

4. A method as defined in claim 3 wherein said amplitude is in the range of 2.8 to 28 mils peak to peak.

5. A method as defined in claim 2 wherein said amplitude is in the range of 2.8 to 28 mils peak to peak.

* * * * *